US006397740B1

(12) United States Patent
Dubuit

(10) Patent No.: US 6,397,740 B1
(45) Date of Patent: Jun. 4, 2002

(54) PRINTING MACHINE INCLUDING AT LEAST ONE SCREENPRINTING STATION AND AT LEAST ONE DIGITAL INKJET PRINTING STATION

(75) Inventor: Jean-Louis Dubuit, Paris (FR)

(73) Assignee: Societe d'Exploitation des Machines Dubuit, Noisy le Grand (FR)

( * ) Notice: Subject to any disclaimer, the term of this patent is extended or adjusted under 35 U.S.C. 154(b) by 0 days.

(21) Appl. No.: 09/416,885

(22) Filed: Oct. 13, 1999

(30) Foreign Application Priority Data

Oct. 22, 1998 (FR) ..... 98 13244

(51) Int. Cl.[7] ..... B41F 17/00; B41F 13/02

(52) U.S. Cl. ..... 101/41; 101/44; 101/114; 101/115; 347/4; 347/2

(58) Field of Search ..... 101/35, 41, 44, 101/114, 115, 126, 129, 485, 486, 490; 347/2, 3, 4

(56) References Cited

U.S. PATENT DOCUMENTS 3,867,882 A * 2/1975 Ahlgren et al. ..... 101/35
5,158,016 A * 10/1992 Dubuit ..... 101/123
5,361,694 A * 11/1994 Dubuit ..... 101/115
5,456,169 A * 10/1995 Rohwetter et al. ..... 101/35
5,657,690 A * 8/1997 Douville et al. ..... 101/116
5,857,410 A * 1/1999 Watanabe et al. ..... 101/116
5,873,315 A * 2/1999 Codos ..... 101/35

FOREIGN PATENT DOCUMENTS

| | | |
|---|---|---|
| DE | 38 20 340 | 6/1989 |
| FR | 2 666 050 | 2/1992 |
| JP | 08-267705 | 10/1996 |

* cited by examiner

*Primary Examiner*—Leslie J. Evanisko
(74) *Attorney, Agent, or Firm*—Young & Thompson

(57) ABSTRACT

A printing machine includes an endless conveyor carrying a plurality of spaced object supports, at least one screenprinting station vertically aligned with the path of movement of the object supports and at least one digital inkjet printing station adapted to operate on demand. Applications include printing compact discs.

17 Claims, 2 Drawing Sheets

PRINTING MACHINE INCLUDING AT LEAST ONE SCREENPRINTING STATION AND AT LEAST ONE DIGITAL INKJET PRINTING STATION

BACKGROUND OF THE INVENTION

1. Field of the Invention

The present invention is generally concerned with printing machines including an endless conveyor which carries a plurality of spaced object supports and at least one screenprinting station vertically aligned with the path of movement of the object supports and adapted to print the objects carried thereby in turn.

2. Description of the Prior Art

Screenprinting stations have many advantages which make them ideal for printing highly diverse articles, for example compact discs.

In particular, they have the advantage of a relatively high throughput, for example in the order of one compact disc every second, because the screen employed covers the entire surface to be printed and so prints it all in one operation.

They are therefore particularly suitable when the number of articles to be printed in series is relatively high, for example greater than one thousand.

However, screenprinting stations have the drawback of requiring adjustment of the position of the screen before printing is started, in order to adjust the position of the printing relative to the surface to be printed. Also, where appropriate, i.e. when a change of color is required, the squeegee and the bottom squeegee associated with the screen must be cleaned.

The corresponding start-up time can be as much as several minutes, for example.

Consequently, when a plurality of screenprinting stations are used to print the same article, with one screenprinting station for each color to be applied to the article, as is frequently the case, the overall time of operation of the printing machine is much greater than the actual printing time, for example three to four times greater than the printing time, which is to the detriment of productivity.

A general object of the present invention is an arrangement which addresses the problem of minimising the effects of the above drawback.

SUMMARY OF THE INVENTION

To be more precise, the present invention consists in a printing machine including an endless conveyor carrying a plurality of spaced object supports, at least one screenprinting station vertically aligned with the path of movement of the object supports and at least one digital inkjet printing station adapted to operate on demand.

Digital inkjet printing stations are well known and have the advantages that they operate directly, without any accessory such as a screen, plate, etc, and so save the cost of any such accessory, and that they can print more than one color without requiring specific adjustment for each color.

It is sufficient for them to include as many printing nozzles as there are colors to be printed and they are appropriately programed to control each printing nozzle in an appropriate manner.

However, operating on a point-by-point and line-by-line basis, digital inkjet printing stations have the drawback of a relatively low throughput, very much lower than that of a screenprinting station.

However, if the number of articles to be printed in series is relatively small, for example less than one thousand, the productivity of a printing machine employing a digital inkjet printing station becomes competitive with that of a printing machine using a screenprinting station, all the more so if more than one color is to be printed on the same article, as is usually the case.

By enabling the user of the printing machine of the invention to use a digital inkjet printing station, for example by substituting it for a screenprinting station, as and when required in accordance with current necessities, to be more precise in accordance with the number of articles to be printed, the invention has the advantage of maintaining acceptable productivity of the printing machine even when the number of articles to be printed is relatively small.

Furthermore, associating a digital inkjet printing station with a screenprinting station is even more advantageous in that inkjet printing requires a layer of absorbent material or varnish on the objects to be printed and a layer of absorbent material or varnish can readily be applied to the objects by a screenprinting station.

The features and advantages of the invention will emerge further from the following description given by way of example and with reference to the accompanying diagrammatic drawings.

DETAILED DESCRIPTION OF THE PREFERRED EMBODIMENT

Figure 1:
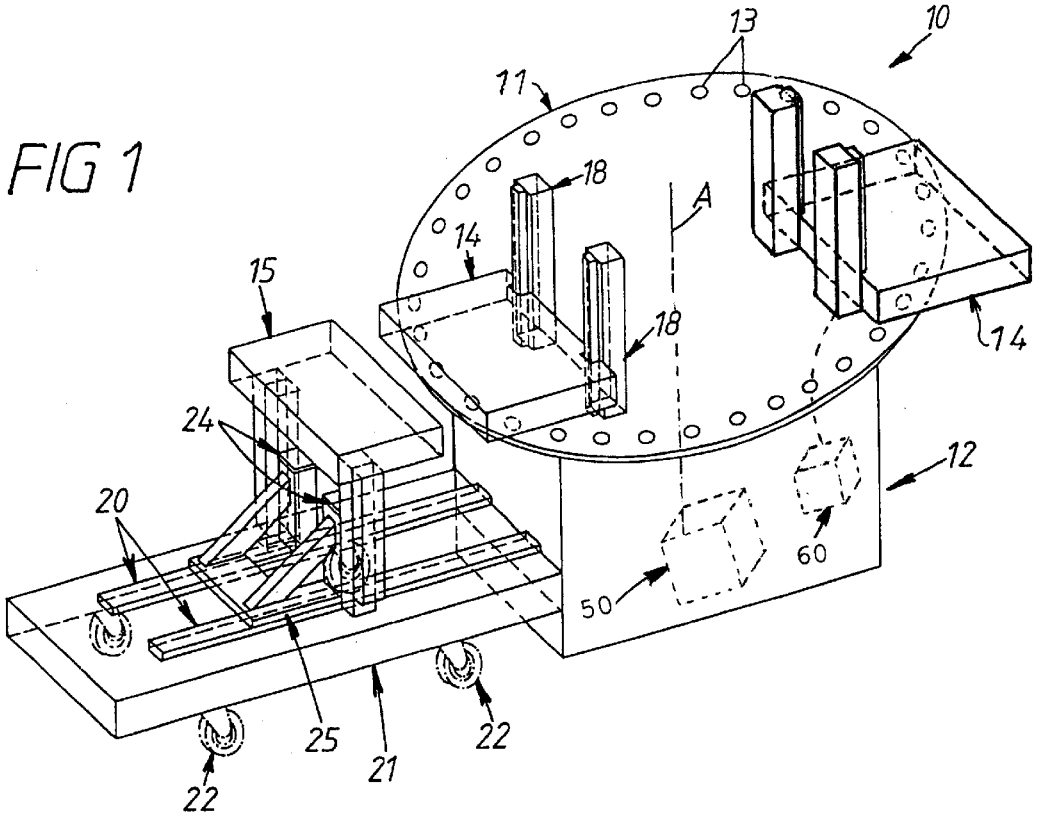
FIG. 1 is a perspective view of a printing machine in accordance with the invention.

As shown in the figures, the printing machine 10 in accordance with the invention includes, in the conventional manner, an endless conveyor 11, which carries a plurality of spaced object supports 13, and at least one screenprinting station 14 vertically aligned with the path of movement of the object supports 13.

As the printing machine 10 is not of itself relevant to the present invention, it is not described in detail here.

This applies in particular to the endless conveyor 11, the object supports 13 and the screenprinting station 14, and is also the reason why the figures show the endless conveyor 11, the object supports 13 and the screenprinting station 14 diagrammatically, by means of their outline.

In the case of the endless conveyor 11, for example, suffice to say that in the embodiment shown it is in the form of a circular contour plate rotated by a driving means 50 on a frame 12, for example, like a turret, and the object supports 13 it carries are circumferentially distributed at a regular pitch around the rotation axis A of the plate.

In the case of the screenprinting station 14, suffice to say that it conventionally employs a screen constituting a stencil, some meshes of which are open and others of which are blocked, depending on the pattern to be printed, and that the screen is associated with a mobile squeegee adapted to force ink through the open mesh.

In practise a plurality of screenprinting stations 14 are disposed around the endless conveyor 11, with one screenprinting station 14 for each color to be applied to the articles to be printed.

For simplicity, the figures show only two screenprinting stations 14.

In practise, each screenprinting station 14 is usually associated with a drying station, not shown.

Other stations, also not shown, can also be provided along the endless conveyor 11, for example a loading and/or offloading station, a dust removal station and a flame treatment station.

According to the invention, the printing machine 10 also includes at least one digital inkjet printing station 15 which can operate as and when required.

As is the case in the embodiment shown, for example, the digital printing station 15 is associated with a screenprinting station 14 and can be substituted for it.

In the embodiment shown, the screenprinting station 14 with which a digital printing station 15 is associated in this way is retractable and moves by an actuating means 60 detachably coupled to driving means 50.

The screenprinting stations 14 other than that for which the digital printing station 15 can be substituted are not necessarily retractable.

However, at least some of them can be retractable, if required.

Figure 4A:
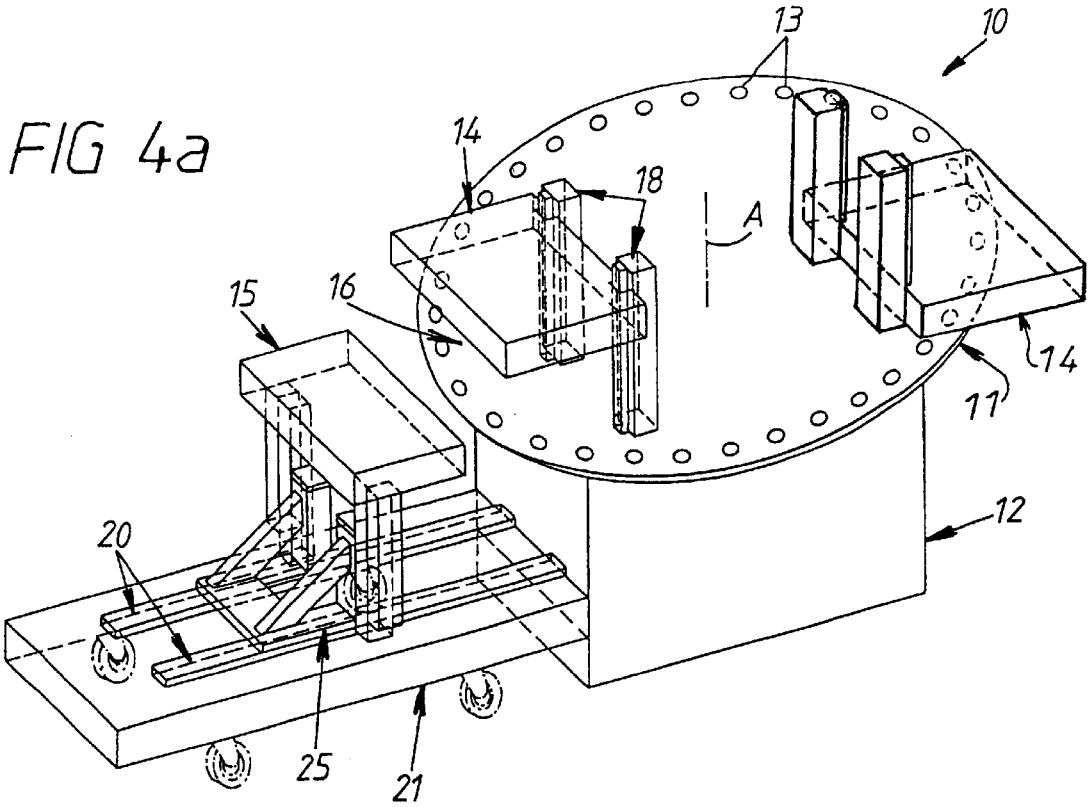
FIGS. 4*a*, 4*b* are perspective views analogous to that of FIG. 1 and show two successive phases in the operation of the printing machine.
Figure 4B:
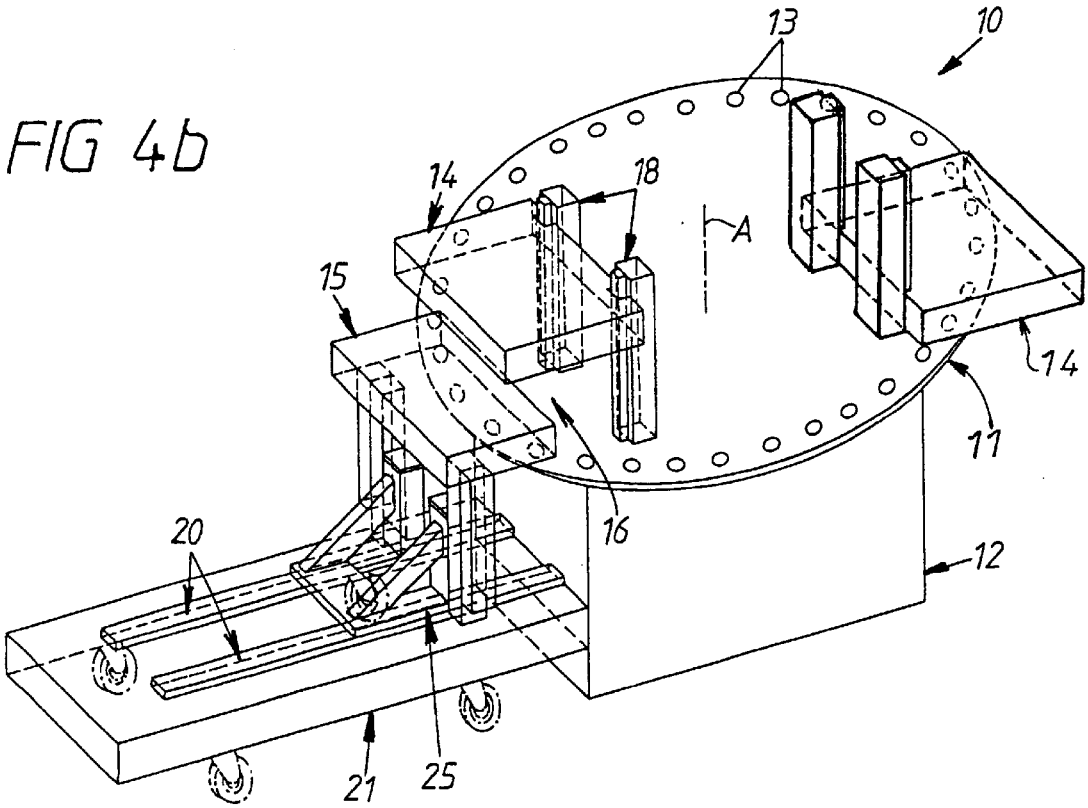

In the embodiment shown, the screenprinting station 14 with which the digital printing station 15 is associated is mobile between an in-service position which is relatively close to the endless conveyor 11 and in which it is able to operate (FIG. 1) and a standby position which is relatively far away from the endless conveyor 11 and in which there is a sufficient gap 16 between it and the conveyor for the digital printing station 15 to be substituted for it (FIGS. 4*a* and 4*b*).

In the embodiment shown, the screenprinting station 14 in practise slides on at least one column 18 substantially perpendicular to the endless conveyor 11.

As shown here, for example, there are two parallel spaced columns 18.

The digital printing station 15 is mobile between a standby position in which it is moved away from the endless conveyor 11 (FIGS. 1 and 4*a*) and an in-service position in which it is substituted for the screenprinting station 14 and vertically aligned with the path of movement of the object supports 13 carried by the endless conveyor 11 (FIG. 4*b*).

In the embodiment shown, the digital printing station 15 in practise slides on at least one rail 20 substantially parallel to the endless conveyor 11.

As shown in FIG. 1, for example, there are two parallel spaced rails 20.

In the embodiment shown, the digital printing station 15 is carried by an independent frame 21, i.e. by a frame 21 separate from the frame 12 carrying the endless conveyor 11 and the screenprinting station 14.

As shown, for example, the frame 21 has wheels 22 for moving it up to the frame 12 and the rails 20, which are carried by the frame 21, enable a finer adjustment of the position of the digital printing station 15 relative to the frame 12 in a direction substantially parallel to the endless conveyor 11, if necessary.

In the embodiment shown, the position of the digital printing station 15 can also be adjusted in the direction substantially perpendicular to the endless conveyor 11.

To be more precise, in this embodiment, it slides on at least one upright 24 substantially perpendicular to the endless conveyor 11 and carried by a carriage 25 which moves on the rails 20.

As shown in FIG. 1, for example, there are two parallel spaced uprights 24.

Figure 2:
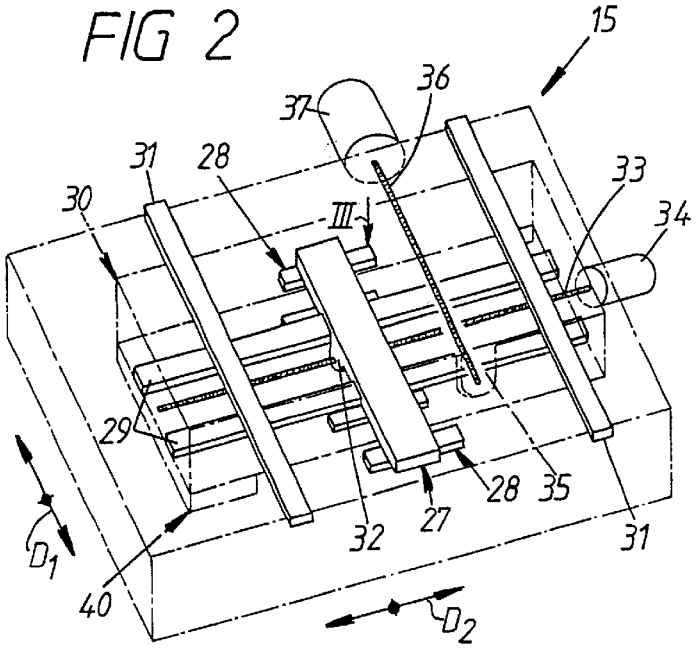
FIG. 2 is a perspective view to a larger scale of its digital inkjet printing station.
Figure 3:
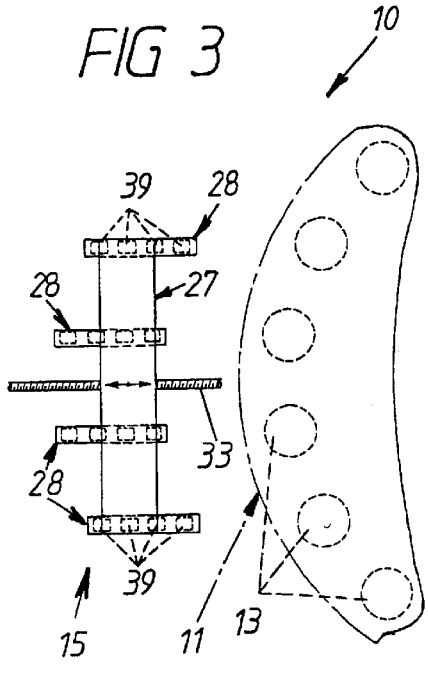
FIG. 3 is a partial plan view of the digital printing station as seen in the direction of the arrow III in FIG. 2 and showing part of the associated endless conveyor.

In the embodiment shown, the digital printing station 15 includes a crossmember 27 mobile in two orthogonal directions D1, D2 in the manner of an X-Y table, as shown by the double-headed arrows in FIG. 2. The crossmember carries at least one printhead 28.

One of the directions D1, D2 in which the crossmember 27 moves, here the direction D1, is in practise substantially tangential to the plate forming the endless conveyor 11, and the other one, here the direction D2, is substantially radial relative thereto.

The crossmember 27 of the digital printing station 15 in practise slides on at least one slideway 29 which is part of a carriage 30 which in turn slides on at least one slideway 31 orthogonal to the slideway 29.

As shown in FIG. 2, for example, there are two spaced parallel slideways 29 and two spaced parallel slideways 31 transversely disposed relative to the slideways 29 and at a distance from them.

For example, the carriage 30 is suspended from the slideways 31, as it were, and the crossmember 27 rests on the slideways 29.

The crossmember 27 is preferably engaged by means of a nut 32 with a screw 33 keyed to the output shaft of a motor 34 and the carriage 30 is preferably engaged by means of a nut 35 with a screw 36 keyed to the output shaft of a motor 37.

In the embodiment shown, the crossmember 27 of the digital printing station 15 is substantially tangential to the plate forming the endless conveyor 11, in the direction D1.

It is therefore substantially perpendicular to the endless conveyor 11.

The crossmember 27 preferably carries at least two printheads 28 which are staggered along its length and offset transversely to one another in the direction of its width, to allow for the radius of the circumference on which the object supports 13 are disposed.

As shown here, for example, the crossmember 27 therefore carries four spaced printheads 28 at a pitch which substantially corresponds to the pitch of the object supports 13 on the endless conveyor 11.

In the embodiment shown, the printheads 28 resemble nacelles on the bottom surface of the crossmember 27 and the bottom surface of each of them carries at least two printing nozzles 39.

As shown here, there are in practise at least four staggered printing nozzles 39 on each printhead 28, along the length thereof, to cater for the requirements of four-color printing.

The printing nozzles 39 are well known, in particular in business printers, and are not described in detail here because they are not in themselves relevant to the present invention.

In the embodiment shown, the carriage 30 of the digital printing station 15 includes a unit 40 at one end of the slideways 29 housing a cleaning device for cleaning the printing nozzles 39.

These arrangements are also well known, in particular in business printers, and are not described in detail here because they are also not in themselves relevant to the present invention.

In normal operation, the screenprinting station 14 is in its in-service position and the digital printing station 15 is in its standby position.

If necessary, as shown diagrammatically in FIG. 4*a*, the screenprinting station 14 is raised to its standby position and the digital printing station 15 is inserted underneath it, into the gap 16 left between it and the endless conveyor 11 (see FIG. 4*b*).

Note that in its in-service position the digital printing station 15 provided in accordance with the invention cooperates with at least two object supports 13, in this particular instance with four of them, one object support 13 per printhead 28, operating simultaneously on the objects to be printed carried by the object supports 13, whereas a screenprinting station 14 cooperates with only one object support 13.

It is therefore advantageously possible for the inkjet printing rate to be approximately the same as the screenprinting rate.

When the digital printing station 15 is in its inservice position it operates at the same time as at least one other screenprinting station 14 if, as mentioned above, the printing machine 10 includes one or more screenprinting stations 14 in addition to that with which the digital printing station 15 is associated.

As already mentioned, the throughput of the screenprinting stations 14 is higher than that of the digital printing station 15, which normally causes them to stop in front of the digital printing station 15 on each stepwise advance of the endless conveyor 11.

In accordance with one subsidiary feature of the invention, modulating means are provided to enable the digital printing station 15 to operate, at least momentarily, at the same time as at least one other screenprinting station 14.

For example, this modulation is achieved by decoupling the means actuating the screenprinting station(s) 14 from the means driving the endless conveyor 11.

Alternatively, or in combination with the above feature, the modulation is achieved by separating the means actuating the screenprinting station(s) 14 and the digital printing station 15.

In accordance with another subsidiary feature of the invention, the means driving the endless conveyor 11 preferably operate at a variable speed, to enable screenprinting at a normal rate, when possible, and inkjet printing at a lower rate, when necessary.

How to provide such modulation will be evident to the skilled person and is not described here.

More generally, the printing machine of the invention can be implemented in highly diverse ways.

This is why the embodiment more particularly referred to is not described in detail here, as its details will be evident to the skilled person.

In any event, the present invention is not limited to this embodiment, but encompasses many variant executions thereof.

In particular, the digital inkjet printing machine can be associated with one or more other stations, for example at least one varnishing station, for example a screenprinting station, and at least one drying station.

Also, the configuration of the endless conveyor employed is immaterial.

For example, it could equally well be a linear endless conveyor.

What is claimed is:

1. A printing machine comprising:

an endless conveyor;

a plurality of object supports spaced from each other on said endless conveyer;

a plurality of screenprinting stations perpendicular to a path of movement of said object supports; and a digital inkjet printing station that is movably interchangeable with one of said screenprinting stations.

2. The printing machine as claimed in claim 1, wherein said one screenprinting station is mobile between a first operable position directly adjacent to said endless conveyer, and a second standby position that is farther away from said endless conveyor than said first operable position, and when said one screenprinting station is in said second position there is a gap between said one screenprinting station and said conveyor sufficient for said digital inkjet printing station to be inserted into said gap.

3. The printing machine as claimed in claim 2, further comprising at least a first column, said one screenprinting station sliding on said first column substantially perpendicular to said endless conveyor, between said first operable position and said second standby position.

4. The printing machine as claimed in claim 1, wherein said digital inkjet printing station is mobile between a standby position in which said digital inkjet printing station is spaced from said endless conveyor, and an operable position in which said digital inkjet printing station is substituted for said one screenprinting station directly adjacent to said endless conveyor.

5. The printing machine as claimed in claim 4, further comprising at least a rail, said digital inkjet printing station sliding on said rail substantially parallel to a plane of said endless conveyor.

6. The printing machine as claimed in claim 5, wherein said digital inkjet printing station also is adjustable substantially perpendicular to said endless conveyor.

7. The printing machine as claimed in claim 4, wherein said digital inkjet printing station, and at least one of said screenprinting stations are simultaneously operable when said digital inkjet printing station is in said operable position.

8. The printing machine as claimed in claim 1 further comprising an independent support frame that supports said digital inkjet printing station spaced from said endless conveyor.

9. The printing machine as claimed in claim 1, wherein said digital inkjet printing station comprises a crossmember mobile in two orthogonal directions and at least one print head attached to said crossmember.

10. The printing machine as claimed in claim 9, wherein said crossmember comprises at least two said print heads that are staggered in a longitudinal direction of said crossmember and offset transversely relative to each other in a transverse direction of said crossmember.

11. The printing machine as claimed in claim 9, wherein said endless conveyor is a rotary circular plate and said crossmember is moveable in at least a direction substantially tangential to said plate.

12. The printing machine as claimed in claim 9, further comprising:

at least a first slideway, said crossmember sliding on said first slideway;

at least a second slideway orthogonal to said first slideway; and a carriage, said carriage sliding on said second slideway.

13. The printing machine as claimed in claim 9, wherein said at least one print head comprises at least four printing nozzles.

14. The printing machine as claimed in claim 1, further comprising:

screenprinting station actuating means for operating another of said screenprinting stations; and endless conveyor driving means for driving said endless conveyor, said actuating means and said driving means being decoupled to enable said first digital inkjet printing station to operate at a same time as said another screenprinting station.

15. The printing machine as claimed in claim 1, further comprising:

screenprinting station actuating means for operating another of said screenprinting station; and endless conveyor driving means for driving said endless conveyor, said actuating means and s aid driving means being separately operable to enable said first digital inkjet printing station to operate at a same time as said another screenprinting station.

16. The printing machine as claimed in claim 1, further comprising endless conveyor driving means for driving said endless conveyor at variable speed.

17. A printing machine comprising:

an endless conveyor;

a plurality of object supports spaced from each other on said endless conveyor;

a first screenprinting station disposed in line with a path of said plurality of object supports and adapted to ensure printing of each object on said plurality of object supports, said screenprinting station having a silk screen comprising a pocket, certain meshes of the silk screen being open and other meshes being blocked according to a pattern to be printed, the silk screen being associated with a scraper adapted to force a product through the open meshes;

at least one digital printing station, operating by an inkjet, and having at least one printing head with at least one printing nozzle, and which is adapted to operate on demand, a layer of absorbent material or varnish being on the object to be printed, the layer being applied by said first screenprinting station before the object to be printed goes to the at least one digital printing station; and a second screenprinting station, said digital printing station being movably interchangeable for said second screenprinting station.

* * * * *